US005595386A

United States Patent [19]

Parsons

[11] Patent Number: 5,595,386

[45] Date of Patent: Jan. 21, 1997

[54] ELONGATED BUTTON LOCK FOR EXPANDABLE BATONS

[75] Inventor: Kevin L. Parsons, Appleton, Wis.

[73] Assignee: Armament Systems and Procedures, Inc., Appleton, Wis.

[21] Appl. No.: 540,952

[22] Filed: Oct. 11, 1995

[51] Int. Cl.[6] ..... F41B 15/02

[52] U.S. Cl. ..... 473/47.7; 135/40; 135/75

[58] Field of Search ..... 273/80 D, 84 R, 273/84 ES; 135/37, 40, 41, 75; 285/298, 301, 302, 317, 7; 473/48; 403/358, 377, 378

[56] References Cited

U.S. PATENT DOCUMENTS

| | | | |
|---|---|---|---|
| 16,565 | 7/1857 | Hickman . | |
| 27,335 | 2/1860 | Rowe . | |
| 365,644 | 6/1887 | Smith . | |
| 1,716,131 | 6/1929 | Hodgson . | |
| 2,420,866 | 5/1947 | Coss | 285/7 |
| 2,980,456 | 8/1959 | McMullin . | |
| 2,989,968 | 6/1961 | Vogel . | |
| 3,371,930 | 3/1968 | Shiga . | |
| 3,712,652 | 1/1973 | Uikema . | |
| 4,037,839 | 7/1977 | Nelson . | |
| 4,752,072 | 6/1988 | Parsons . | |
| 4,964,636 | 10/1990 | Ashihara . | |
| 5,149,092 | 9/1992 | Parsons . | |
| 5,160,140 | 11/1992 | Starrett | 273/84 R |
| 5,320,348 | 6/1994 | Starrett | 273/84 R |

FOREIGN PATENT DOCUMENTS

| | | |
|---|---|---|
| 543517 | 7/1957 | Canada . |
| 2-40499 | 2/1990 | Japan . |

*Primary Examiner*—William M. Pierce

*Attorney, Agent, or Firm*—Robert C. Curfiss; Mark A. Tidwell; Butler & Binion, L.L.P.

[57] ABSTRACT

A detent mechanism for expandable batons of the type having a handle and at least one telescoping section. The detent mechanism including an elongated, substantially rectangular-shaped, locking button designed to provide a wide, flat surface to wide, flat surface contact for preventing deformation of the locking button and/or the mating tube of the telescoping baton section during the "recoil" and "bounce back" caused by the rapid extension of the baton to its expanded position. The locking button has radiused top edges and a top surface radiused to match the radius of the inner wall of the mating tube. The detent mechanism also includes a radiused inner recess for receiving the locking button and holding the baton in the retracted position and a biasing means in communication with the button for normally urging the button into the extended, projecting position.

9 Claims, 1 Drawing Sheet

ELONGATED BUTTON LOCK FOR EXPANDABLE BATONS

BACKGROUND OF INVENTION

1. Field of Invention

The subject invention is generally related to expandable batons and is specifically directed to a button lock configuration for locking the baton in the expanded position.

2. Description of the Prior Art

Nightsticks and batons are well known and have gained widespread acceptance as intermediate force weapons for use by law enforcement personnel. One of the best known intermediate force weapons is the ASP Expandable Baton manufactured by Armament Systems and Procedures, Appleton, Wis., the assignee of the subject invention. Typically, the ASP Baton includes three telescoping sections, the largest section defining a handle adapted for receiving and nesting the remaining sections when the baton is in the collapsed position. In the collapsed position, the baton is approximately 8 to 10 inches long and can be carried by law enforcement personnel in a suitable sheath on the belt of the uniform. The baton is adapted to be drawn quickly from the sheath and opened in a swinging action for whipping the nested sections out to an extended position and locking in position for use as an intermediate force weapon.

Examples of other extendable batons are shown in U.S. Pat. No. 27,335 issued to J. L. Rowe on Feb. 28, 1860; U.S. Pat. No. 3,371,930 issued to Y. Shiga on Mar. 5, 1968 and U.S. Pat. No. 4,037,839 issued to N. C. Nelson on Jul. 26, 1977.

The subject invention is specifically directed to an improvement in the type of detent mechanism for expandable batons shown in my U.S. Pat. No. 5,149,092 entitled "Locking Means for Extendable Baton" issued on Sep. 22, 1992. This patent discloses a locking means for an expandable baton including a detent button and multiple, parallel tapered stop surfaces for limiting the axial movement of the telescoping shafts of the baton. The detent button is round or spherical shaped and is positioned on each telescoping shaft of the baton. The button is biased to project outward and provides an abutment surface when the baton is in the extended position for maintaining the extended position. When the baton is in the retracted position, the button projects outward into a channel adapted to receive the button and holds the telescoping shafts in the retracted position.

While the detent button provides a simple yet effective means for locking an expandable baton in either the retracted or extended position, there is a problem with the prior art detent button as used with expandable batons. It has been found that the rapid extension of the expandable batons causes "recoil" and "bounce back" when the telescoping shafts reach the positive stop surface and the metal tube of the outer shaft contacts the metal stop surface of the telescoping shaft. This "recoil" is similar to the reaction caused when a car hits a wall, stops abruptly and then rebounds or recoils away from the wall. The same phenomenon takes place as the telescoping shaft of the baton flies forward and is stopped abruptly by the positive stop in the forward direction. The shaft then "recoils" and "bounces back" and the detent button positioned adjacent to the shaft is thrown against the surface of the mating tube.

While round or spherical buttons provide a smooth release and retraction of the telescoping shafts of the baton for easily expanded and retracting the baton, this type of button has been found to cause deformation of the button and/or the edges of the mating tube due to recoil because the line of contact between the button and the tube is along a vertical axis of the button and concentrated at a specific point. Each time the baton is whipped into the expanded position for use, the button is recoiled into contact with the mating tube which causes an indentation along the edge of the tube and may eventually deform the button. After repeated use, the telescoping shafts jam and are non-functioning.

One method of addressing the problems caused by the rapid extension of expandable batons is shown in U.S. Pat. No. 5,320,348 issued to P. D. Starrett on Jun. 14, 1994. U.S. Pat. No. 5,320,348 discloses a baton with a hollow sleeve, telescoping shaft housed within the sleeve and a stop extending from the interior wall of the sleeve for limiting forward movement of the shaft. In order to buffer the contact between the stop and shaft when the shaft is rapidly extended, the baton includes a shock absorbing means comprising a hard plastic ring and a pair of elastomeric O-rings positioned on the shaft. While buffer systems such as sleeves for the edges of the mating tubes or o-rings, as shown in U.S. Pat. No. 5,320,348, have been tried, these methods have not proven effective since the buffer is weakened after repeated use and fails to provide the necessary protection. Further, heat treated buttons are too hard and brittle, while soft buttons are too easily deformed to be effective.

In addition to deforming the shape of the button and/or the enclosing tube, the "recoil" and "bounce back" phenomenon may cause the detent button of the prior art to tilt on the biasing spring so that the button does not sit straight on the spring, making it difficult to retract the telescoping sections. While this problem may be overcome with a stiffer spring, higher compression in the spring makes it more difficult to depress the buttòn and retract the baton.

Therefore, there is a need for an improved detent mechanism which provides a means for selectively locking an expandable baton in either the retracted or extended position while preventing deformation of the detent lock and the telescoping sections of the baton.

SUMMARY OF THE INVENTION

The subject invention is directed to a detent mechanism for expandable batons of the type having a handle and at least one telescoping section, where the handle and telescoping section are mating tubes for the adjacent telescoping section. The expandable baton also includes a positive stop for limiting the axial movement of the telescoping section relative to the mating tube once the baton is fully extended. The detent mechanism of the subject invention includes a uniquely shaped, moveable button and interacting inner recess for selectively locking the telescoping sections of the baton in either the retracted or expanded position.

The subject invention is specifically directed to an improved detent mechanism for expandable batons which includes an elongated, substantially rectangular-shaped button designed to provide a wide, flat surface to wide, flat surface contact during the "recoil" and "bounce back" for preventing deformation of the button and/or the mating tube of the telescoping baton section. The button is positioned on the telescoping sections of the baton and defines an elongated, flat abutment surface between the projecting button and the mating tube when the telescoping sections are expanded. The button is moveable between an extended, projecting position and a retracted position and is normally urged toward the extended, projecting position by a biasing means, such as a compression spring.

In use, the locking button projects from the telescoping section of the extended baton and provides a flat, abutment surface against the mating tube for precluding inadvertent collapse and retraction of the telescoping baton sections. Because the elongated button provides a wide, flat contact surface, the impact of the contact between the button and mating tube caused by the "bounce back" phenomenon is spread across a wide, flat surface and is not concentrated along a vertical axis. Thus, the unique design of the subject invention prevents deformation of the button or mating tube. In order to retract the telescoping section, the button is depressed to a position at or below the outer surface wall of the telescoping section allowing the baton to be fully collapsed. Once the telescoping sections are retracted, the button is urged to its extended, projecting position for holding the sections in the retracted position.

For tube retention and to prevent the button from constantly dragging against and wearing the mating tube, the button of the preferred embodiment of the subject invention includes smooth, radiused edges and a radiused top surface. Because the top surface of the button is radiused to match the inside diameter of the mating tube, the button is uniquely shaped to conform to the interior wall of the mating tube. The detent mechanism of the subject invention includes an inner recess or channel in the mating tube for receiving the button and holding the telescoping sections in the retracted position. Because the top edges of the button are radiused, the button will self-depress when a whipping motion applies forward pressure on the telescoping sections forcing the button out of the inner recess in the mating tube and expanding the baton. In the preferred embodiment, the edges of the inner recess are also radiused so that the smooth, radiused edges of the button engage the radiused edges of the inner recess for facilitating the release of the button from the inner recess when a whipping motion is applied to expand the baton. Further, the unique shape of the button and radiused inner recess eliminate any restrictions on the hardness of the button. In fact, a plastic button could be used in this configuration.

In the preferred embodiment, the telescoping sections of the expandable baton include an elongated, substantially rectangular slot for holding the button which extends upward through the slot when the button is in the extended, projecting position. Because failure to provide a close fit between the slot and locking button may cause excessive bounce back and increase the binding, the slot is specifically designed to closely fit the peripheral shape of the button.

In the preferred embodiment, the locking button is biased by a substantially "C-shaped" leaf spring having an enlarged flat base which extends generally in the direction parallel to the longitudinal axis of the baton. The opposite ends of the legs of the leaf spring are upturned at their outer ends to minimize the tendency of the legs to snag or engage the interior surface of the telescoping member as the button is depressed and the baton is retracted. This also assures that both legs of the spring move in a uniform manner, providing a uniform biasing force against the button normally urging the button to the extended, projecting position.

Further, the locking button of the detent mechanism is dimensioned to always stay at or below the surface of the abutting mating tube to minimize the likelihood of inadvertent depression of the button, making it difficult for an assailant to grasp the baton and collapse it as it is being used by an officer. The detent mechanism of the subject invention also provides for telescoping sections which are rotational a full 360 degrees relative to one another, eliminating, misalignment, and twisting destructive attempts.

The improved detent mechanism of the subject invention provides a uniquely shaped button for preventing deformation of the button and/or the mating tube and a radiused inner recess for engaging the button when the telescoping sections are in the retracted position and maintaining the baton in the collapsed position.

Therefore, it is an object and feature of the subject invention to provide an improved detent mechanism for expandable batons which includes an elongated, substantially rectangular-shaped button positioned on the telescoping sections of the baton and moveable between an extended, projecting position and a retracted position for selectively locking the baton in either the retracted or expanded position.

It is a further object and feature of the subject invention to provide an improved detent mechanism having a locking button which defines an elongated, flat abutment surface between the projecting button and the mating tube when the telescoping sections are expanded for preventing deformation of the button and/or the mating tube.

It is another object and feature of the subject invention to provide a locking button having a radiused top surface and radiused edges for retaining the tube and preventing the button from constantly dragging against and wearing the mating tube.

It is yet another object and feature of the subject invention to provide a detent mechanism having an inner recess for selectively locking the section in the retracted position and including radiused outer edges for the smooth engagement and release of the button into and out of the inner recess.

It is a further object and feature of the subject invention to provide a detent mechanism including a slot in each telescoping section adapted to closely fit the peripheral shape of the locking button which is positioned within the slot and is extendable upward through the slot.

It is yet another object and feature of the subject invention to provide a detent mechanism with a biasing means in communication with the locking button for normally urging the button into the extended, projecting position.

Other objects and features will be readily apparent from the accompanying drawings and description.

DETAILED DESCRIPTION OF THE DRAWINGS

Figure 3:
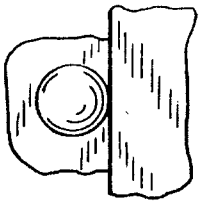
FIG. 3 PRIOR ART
FIG. 3 (PRIOR ART) showing that the line of contact between the prior art spherical button and mating tube is along a vertical axis and concentrated at a specific point.
Figure 2:
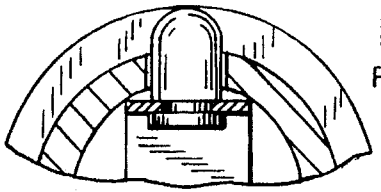
FIG. 2 PRIOR ART
FIG. 2 (PRIOR ART) is a cross-sectional view showing the spherical shaped button of the prior art detent mechanism as positioned in relation to the mating tube of the telescoping section.
Figure 1:
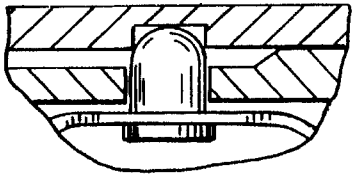
FIG. 1 PRIOR ART
FIG. 1 (PRIOR ART) is a cross-sectional showing the prior art detent mechanism including a spherical shaped button and non-radiused interacting channel.

FIGS. 1, 2 and 3 illustrate the prior art detent mechanism as disclosed in my U.S. Pat. No. 5,149,092. As shown, the detent button of the prior art is spherical or dome-shaped. Because the spherical shape allows the button to move easily into and out of the channel adapted to receive the button and hold the baton in the retracted position, the channel of the prior art does not include radiused edges. While the prior art detent mechanism works to selectively lock the expandable baton in either the retracted or extended position, one of the problems with the prior art detent mechanism was that spherical shaped buttons deformed the mating tube. As best seen in FIG. 3, the line of contact between the mating tube and a circular or spherical shaped button is along a vertical axis and concentrated at a specific point. The force with which the metal button hits the metal tube at the contact point creates an indentation along the open end of the mating tube. After repeated use, the tube becomes deformed and the baton sections jam and are difficult to expand and retract and the baton is eventually non-functional.

The detent mechanism of the subject invention addresses the problem caused by the "recoil" and "bounce back" phenomenon and provides a locking button which effectively locks the baton in either the retracted or extended position while preventing deformation of the mating tube.

Figure 4:
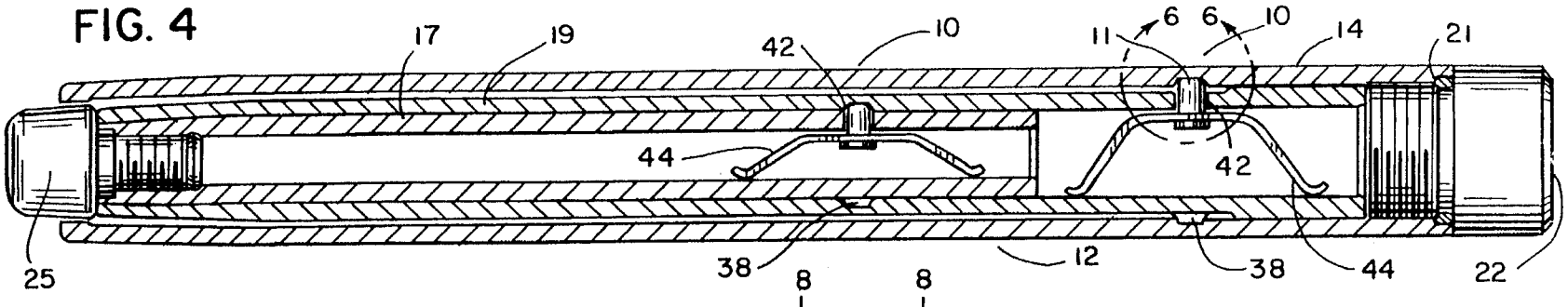
FIG. 4 is a cross-sectional view of an expandable baton in a collapsed position showing the telescoping sections of the baton nested in the handle and the detent mechanism of the subject invention including a locking button and biasing means.
Figure 5:
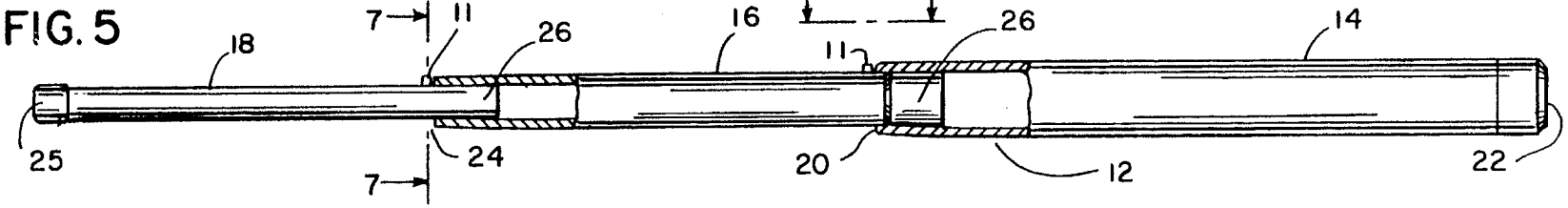
FIG. 5 is a perspective view of the expandable baton in its extended position with a partial cross sectional view showing the end portions of the handle and telescoping sections defining mating tubes for the adjacent telescoping section and showing the locking button and positive stop at one end of each telescoping section.

The subject invention is shown in FIGS. 4–8 and is specifically directed to a detent mechanism 10 for expandable batons of the type having a handle and at least one telescoping section. As shown in FIGS. 4 and 5, the expandable baton 12 includes an elongate hollow tube defining a handle 14 and telescoping sections 16 and 18 nested within the handle 14. The handle 14 has opposite ends with a reducing tapered outer end 20 and a threaded bottom end 21 adapted to received an endcap 22. Each telescoping section 16 and 18 comprises an elongate, hollow tube having an inner wall 17 and outer wall 19, reducing tapered outer end 24 and an enlarged tapered inner end 26. The tapered outer end 24 of the telescoping section 18 may include a removable tip 25.

As shown, the handle 14 forms a mating tube for the adjacent telescoping section 16 and the telescoping section 16 forms a mating tube for the telescoping section 18. The enlarged tapered inner end 26 provides a positive stop for limiting the axial movement of the telescoping sections 16 and 18 relative to its mating tube once the baton is fully extended. In use, the "recoil" and "bounce back" phenomenon causes the locking button of the detent mechanism 10 to be thrown against the front edges or rim  of the mating tube. In the past, the "recoil" and "bounce back" phenomenon would cause the button to make indentations along the rim 30 at the point of contact deforming it so that after repeated use, the telescoping sections 16 and 18** would jam and become non-functioning.

Figure 8:
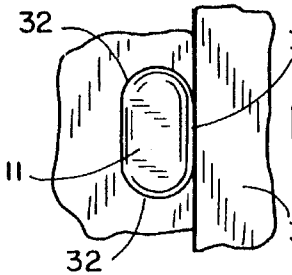
FIG. 8 is a cross-sectional view taken along line 8—8 of FIG. 5 showing that the elongated, rectangular-shaped button of the subject invention provides a wide, flat surface to wide, flat surface contact between the button and mating tube.
Figure 7:
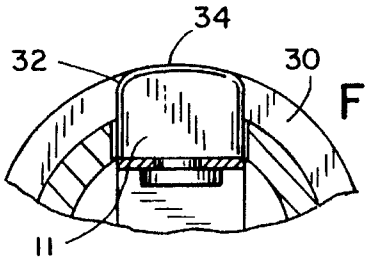
FIG. 7 is a cross-sectional view taken along the line 7—7 of FIG. 5 showing the elongated, rectangular-shaped button of the subject invention including radiused edges and a radiused top surface as positioned in relation to the mating tube of the telescoping section.
Figure 6:
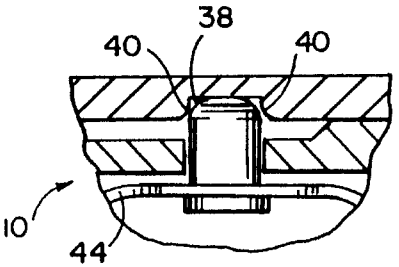
FIG. 6 is an enlarged view of the area 6—6 of FIG. showing the detent mechanism of the subject invention including a uniquely shaped button with radiused edges and a radiused interacting channel.

The detent mechanism 10 of the subject invention includes an elongated, substantially rectangular shaped button 11 for selectively locking the expandable baton in either the retracted or extended position. The locking button 11 has peripheral edges 32 and a top surface 34. As shown in FIGS. 6, 7 and 8, the top edges 32 of the button 11 are radiused for allowing the button to self-depress when the telescoping sections 16 and 18 are whipped into the expanded position. In addition, the top surface 34 is radiused for retaining the telescoping sections 16 and 18 in the retracted position. The radiused top edges 32 and radiused top surface 34 also help to prevent the locking button 11 from constantly dragging against and wearing the mating tube. In the preferred embodiment, the top surface 34 is radiused to match the diameter of the inner wall 17 of the mating tube (see FIG. 7).

As shown in FIGS. 4 and 5, the locking button 11 is mounted near the inner end 26 of each telescoping member 16 and 18 and projects outward from the outer wall 19 of the telescoping sections to provide a flat, abutment surface against the mating tube for precluding inadvertent collapse and retraction of the telescoping baton sections 16 and 18. As best seen in FIG. 8, the elongated, substantially rectangular shape of the button 11 provides a wide, flat contact surface 36 so that the impact of the contact between the button 11 and the rim 30 of the mating tube caused by the "bounce back" phenomenon is spread across the wide, flat surface 36 and is not concentrated along a vertical axis (see prior art FIG. 3) and prevents deformation of the button and/or the tube.

The detent mechanism 10 of the subject invention also includes an inner recess 38 along the diameter of the inner wall 17 of the mating tubes. The inner recess 38 is adapted to engage the locking button 11 when the telescoping sections 16 and 18 are in the retracted position for selectively locking the sections in the retracted position. As shown in FIG. 6, the inner recess 38 of the preferred embodiment includes radiused peripheral edges 40 for facilitating the engagement and release of the locking button 11 into and out of the inner recess 38.

In the preferred embodiment of the subject invention, each telescoping section 16 and 18 includes an elongated, substantially rectangular slot 42 extending through the outer and inner walls 17 and 19 for receiving the locking button 11. The slot 42 is adapted to closely fit the peripheral shape of the locking button 11. The button 11 is positioned on each telescoping section 16 and 18 to pass through the slot 42. As shown in FIG. 4, the locking button 11 is mounted on a biasing means, such as by way of example, a substantially C-shaped leaf spring 44, in the well known manner, and is normally biased outward from the outer wall 19 of the telescoping sections 16 and 18 to extend through the slot 42.

When the expandable baton 12 is in the retracted position of FIG. 4, the button 11 is biased toward and projects into the inner recess 38 for maintaining the telescoping sections 16 and 18 in the retracted, nested position. The force of the spring 44 is sufficient to hold the sections 16 and 18 in the nested position during normal conditions. When the expandable baton is whipped into the expanded position of FIG. 5, the locking button 11 projects outward from the extended telescoping sections of the baton and provides a flat, abutment contact surface 36 against the mating tube for precluding inadvertent collapse and retraction of the telescoping baton sections. In the preferred embodiment, the locking button 11 is at least ¼ inches in length and ⅛ inches in width and extends outwardly from the outer wall 19 of the telescoping sections 16 and 18 to a distance not exceeding the outer wall or rim 19 of the mating tube. This helps to prevent the inadvertent depression of the locking button by the officer or an assailant attempting to grab the telescoping sections and undesirable collapse of the baton during use.

While specific embodiments and features of the invention have been disclosed herein, it will be readily understood that the invention encompasses all enhancements and modifications within the scope and spirit of the following claims.

What is claimed is:

1. An expandable baton of the type having a handle and at least one telescoping section nesting within the handle, the telescoping section moveable between a retracted position and an expanded position, said handle and telescoping section defining mating tubes for the adjacent telescoping section, the improvement comprising:

a detent mechanism having an elongated, generally rectangular-shaped button positioned on said telescoping section, said button moveable between an extended, projecting position and a retracted position wherein said button in the extended, projecting position defines an elongated, flat abutment surface between the button and the mating tube when the telescoping section is in the expanded position for locking the section in the expanded position.

2. The expandable baton of claim 1, said button further including a top surface and peripheral edges wherein the top surface of the button is radiused for retaining the telescoping section in the retracted position.

3. The expandable baton of claim 2, wherein the top edges of the button are radiused for allowing the button to self-depress when the telescoping section is whipped into the expanded position.

4. The expandable baton of claim 3, wherein the mating tubes include an outer wall and an inner wall, said inner wall having an inside radius and wherein the radius of the top surface of the button matches the inside radius of the inner wall of the mating tube for retention of the telescoping section.

5. The expandable baton of claim 4, said inner wall further including an inner recess adapted to engage the button when the telescoping section is in the retracted position for selectively locking the section in the retracted position.

6. The expandable baton of claim 5, wherein said inner recess further includes radiused outer edges for facilitating the engagement and release of the button into and out of the inner recess.

7. The expandable baton of claim 5, further including a biasing means in communication with the button for normally urging the button into the extended, projecting position.

8. The expandable baton of claim 7, wherein said biasing means is a compression spring.

9. The expandable baton of claim 1, wherein said telescoping section further includes an elongated, substantially rectangular slot extending through the outer and inner walls for receiving the button, said slot adapted to closely fit the peripheral shape of the button, wherein said button is positioned within the slot and extends upward through the slot in the extended, projecting position.

* * * * *